US011092322B2

(12) United States Patent
Zhou et al.

(10) Patent No.: US 11,092,322 B2
(45) Date of Patent: Aug. 17, 2021

(54) LAMP

(71) Applicant: CONSUMER LIGHTING (U.S.), LLC, Norwalk, CT (US)

(72) Inventors: Huisheng Zhou, Shanghai (CN); Wubin Zhang, Shanghai (CN); Yin Suo, Shanghai (CN); Xin Qian, Shanghai (CN)

(73) Assignee: SAVANT TECHNOLOGIES LLC, East Cleveland, OH (US)

( * ) Notice: Subject to any disclaimer, the term of this patent is extended or adjusted under 35 U.S.C. 154(b) by 0 days.

(21) Appl. No.: 17/013,529

(22) Filed: Sep. 4, 2020

(65) Prior Publication Data

US 2021/0095840 A1 Apr. 1, 2021

(30) Foreign Application Priority Data

Sep. 26, 2019 (CN) ..... 201921618253.X

(51) Int. Cl.

| | |
|---|---|
| ***F21V 23/00*** | (2015.01) |
| ***F21K 9/233*** | (2016.01) |
| ***F21V 23/04*** | (2006.01) |
| ***H05B 45/28*** | (2020.01) |
| ***F21K 9/238*** | (2016.01) |

(52) U.S. Cl.

CPC ..... *F21V 23/004* (2013.01); *F21K 9/233* (2016.08); *F21K 9/238* (2016.08); *F21V 23/04* (2013.01); *H05B 45/28* (2020.01)

(58) Field of Classification Search

CPC ..... F21V 23/004; F21V 23/04; F21K 9/233; F21K 9/238; H05B 45/28

See application file for complete search history.

(56) References Cited

U.S. PATENT DOCUMENTS

2011/0095709 A1* 4/2011 Diehl ..... F21V 23/04 315/363
2011/0121727 A1* 5/2011 Sharrah ..... F21L 4/00 315/32
2013/0010470 A1* 1/2013 Min ..... F21V 7/18 362/238

(Continued)

FOREIGN PATENT DOCUMENTS

CN 201351822 Y * 11/2009
CN 202048258 U * 11/2011

(Continued)

*Primary Examiner* — Mary Ellen Bowman

(74) *Attorney, Agent, or Firm* — Wood IP LLC

(57) ABSTRACT

The present application discloses a lamp, which comprises a housing, a radiator being provided with an accommodating space for accommodating a light source and a Printed Circuit Board (PCB) board, an optical device having a bottom surface facing towards the radiator and a top surface facing towards external space, and a switch being connected to the PCB board, wherein the optical device comprises an actuator which is cooperated with the switch, wherein the optical device is rotatably arranged relative to the radiator so that the switch is switched by the actuator. By means of such an arrangement, a user may manually rotate the optical device of the lamp to drive the switch located inside the lamp to be switched, so that the lamp is conveniently switched between different color temperatures, for example between cold light and warm light.

14 Claims, 4 Drawing Sheets

(56) References Cited

U.S. PATENT DOCUMENTS

| | | | | |
|---|---|---|---|---|
| 2013/0068439 | A1* | 3/2013 | Zeng | F21K 9/233<br>165/185 |
| 2014/0049963 | A1* | 2/2014 | McGuire | F21V 19/04<br>362/249.01 |
| 2018/0206305 | A1* | 7/2018 | Van Winkle | F21V 19/002 |

FOREIGN PATENT DOCUMENTS

| | | | | | |
|---|---|---|---|---|---|
| CN | 102654255 | A | * | 9/2012 | F21V 23/0471 |
| CN | 103748412 | A | * | 4/2014 | F21V 29/83 |
| CN | 106641773 | A | * | 5/2017 | |
| WO | WO-2015145855 | A1 | * | 10/2015 | F21V 17/12 |

* cited by examiner

LAMP

TECHNICAL FIELD

The present application relates to a lamp, and in particular, to a downlight or a spotlight generally used in buildings.

BACKGROUND

In a current market, a lamp used in buildings or other structures generally has a constant color temperature only, so as to emit a type of light with a determined color. Along with improvement of lamplight requirements of people to environmental space, how to change the lamplight color without replacing a lamp light source becomes an important subject at present.

SUMMARY

In view of this, the present application provides a lamp in order to overcome the defects of a conventional lamp and meet requirements of people. The lamp may comprise a housing, a radiator being provided with an accommodating space for accommodating a light source and a Printed Circuit Board (PCB) board, an optical device having a bottom surface facing towards the radiator and a top surface facing towards external space; and a switch being connected to the PCB board, wherein the optical device comprises an actuator which is cooperated with the switch, wherein the optical device is rotatably arranged relative to the radiator such that the switch is switched by the actuator. By means of such an arrangement, a user may manually rotate the optical device of the lamp to drive the switch in the lamp to be switched, so that the lamp is conveniently switched between different color temperatures, for example between cold light and warm light.

Further, the radiator may be cup-shaped, and the optical device may be at least partially arranged in the radiator.

Further, the bottom surface may be an arc surface, and the top surface may be a flat surface.

Further, the actuator may comprises two tabs protruded from an eccentric position on the bottom surface, the two tabs are mutually parallel and separated by a predetermined space, and a switching trigger arranged on the switch is accommodated in the predetermined space.

Further, the top surface may be provided with a texture pattern so as to increase a friction coefficient of the top surface. By means of such an arrangement, the user may conveniently rotate the optical device by hands.

Further, the optical device may further comprises a radially extended annular boss positioned at the top, which is arranged outside the radiator and placed on an annular top edge of the radiator, wherein the annular top edge of the radiator is provided with an annular groove therein, and a seal ring is provided in the annular groove.

Further, the optical device may further comprises a plurality of hooks downwards extended from the annular boss, the radiator may further comprises an annular recess dented into an inner side wall of the radiator, and the plurality of hooks are cooperated with the annular recess so that the optical device is fixed with the radiator. By such an arrangement, the optical device may be more stably fixed in the lamp.

Further, the optical device may further comprises at least one protrusion transversely outwards extended from an edge of the annular boss. The protrusion may achieve dual functions of enabling the user to conveniently rotate the optical device and indicating a rotation position.

Further, the actuator may be arranged on the bottom surface of the optical device, and the switch may be arranged on the inner side wall or an inner bottom wall of the radiator, so that the switch is triggered by rotating the optical device.

Further, the optical device may comprises a flat diffuser and a conical reflector, the diffuser has the top surface, the reflector has the bottom surface, and the diffuser is fixed with the reflector together.

By means of the lamps of the present application, the user may simply rotate the optical device manually so that the same lamp can be switched between different color temperatures, so as to emit lights with different colors.

BRIEF DESCRIPTION OF THE DRAWINGS

The drawings are used for providing further understanding to the present application and constitute a part of the present application, the schematic embodiments of the present application and the description thereof are used for explaining the present application, and are not intended to form inappropriate limitation to the present application. Wherein.

DETAILED DESCRIPTION OF THE EMBODIMENTS

Technical solutions in the embodiments of the present application are described in detail in combination with the drawings in the embodiments of the present application below. It is to be noted that the embodiments in the present application and features in the embodiments may be mutually combined without conflicting.

Figure 1:
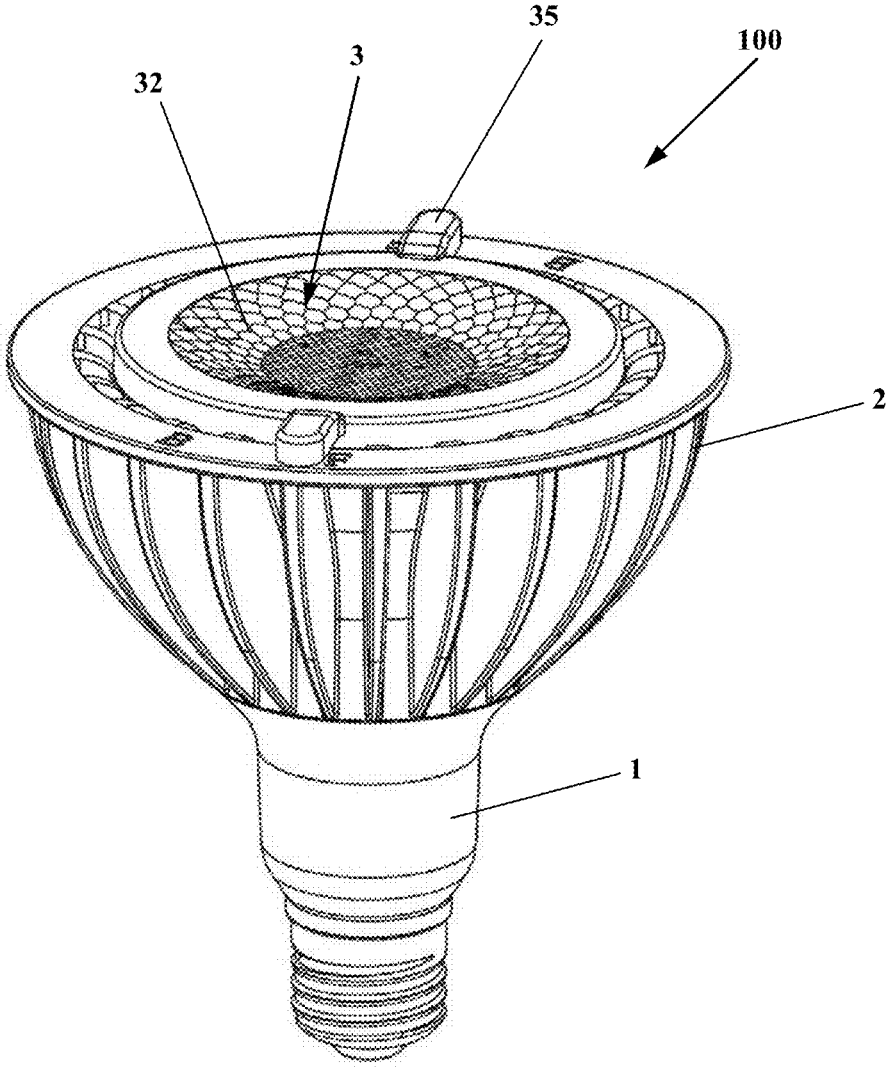
FIG. 1 shows a perspective view of a lamp according to a first embodiment of the present application.

Firstly, a lamp 100 of the first embodiment of the present application is described by reference to FIG. 1 and FIG. 2, wherein the lamp is generally suitable for a spotlight.

Generally, the lamp 100 according to the first embodiment of the present application comprises a housing 1, a radiator 2, an optical device 3 and a switch 4. The switch 4 may be a slide switch. The radiator 2 is installed around the exterior of the housing 1 and connected to the housing 1. The radiator 2 is provided with an accommodating space for accommodating a light source and a PCB board 20. The optical device 3 has a bottom surface 31 facing towards the radiator 2 and a top surface 32 facing towards external space. The switch 4 is connected to the PCB board 20, for example arranged on the PCB board 20, wherein the optical device 3 comprises an actuator 5 which may be arranged on the bottom surface 31 and cooperated with the switch 4, wherein the optical device 3 is rotatable relative to the radiator 2, such that the switch 4 can be switched by the actuator 5. A user may manually rotate the optical device 3 of the lamp 100 to drive the switch 4 located inside of the lamp 100 to be switched, so that the lamp 100 may be conveniently switched between different color temperatures, for example between cold light and warm light.

The radiator 2 may be cup-shaped, but not limited to this. The optical device 3 may be at least partially arranged in the radiator 2.

The bottom surface 31 may be an arc surface, and the top surface 32 may be a flat surface, but not limited to this. As shown in FIG. 2, the bottom surface 31 may be a convex arc surface.

The actuator 5 may comprises two tabs protruded from an eccentric position on the bottom surface 31, the two tabs are mutually parallel and separated by predetermined space P, and a switching trigger 41 arranged on the switch 4 is accommodated in the predetermined space P. When the user rotates the optical device 3, and the two tabs may perform rotation movement in a certain degree along with the optical device 3. During the rotation movement, one of the tabs abuts against the switching trigger 41 of the switch 4, so that the switching trigger 41 is driven to perform a translation movement, thereby the switch 4 is switched. Preferably, the switch 4 is a slide switch. The actuator 5 may be arranged on the bottom surface 31 of the optical device 3, and the switch 4 may be arranged on an inner side wall 25 or an inner bottom wall of the radiator 2, so that the switch 4 is triggered by rotating the optical device 3.

In the predetermined space P, the switching trigger 41 may have a certain margin, in other words, the switching trigger 41 does not simultaneously close contact with the two tabs. By providing such margin, a torsion effect which may be applied to the switching trigger 41 by a movement component in a radial direction while the tabs perform the rotation movement may be decreased in a certain degree.

The top surface 32 may be provided with a texture pattern so as to increase a friction coefficient of the top surface 32, which is convenient for the user to rotate the lamp while a hand of the user contacts with the top surface 32 of the lamp 100. A specific form of the texture pattern is not specifically limited.

The optical device 3 may further comprises a radially extended annular boss 33 positioned at the top, which is arranged outside the radiator 2 and placed on an annular top edge 22 of the radiator 2, wherein the annular top edge 22 of the radiator 2 is provided with an annular groove 23 therein, and a seal ring 24 is provided in the annular groove 23, so as to prevent water vapor or dust and the like from entering the interior of the lamp 100.

The optical device 3 may further comprises a plurality of hooks 34 downwards extended from the annular boss 33, the radiator 2 may further comprises an annular recess 26 dented into an inner side wall 25 of the radiator 2, and the plurality of hooks 34 are cooperated with the annular recess 26 so that the optical device 3 is fixed with the radiator 2. Of course, the radiator 2 may comprises a plurality of recesses circumferentially separated, instead of the integrated annular recess 26, for respectively cooperating with each of the plurality of hooks 34.

Figure 2:
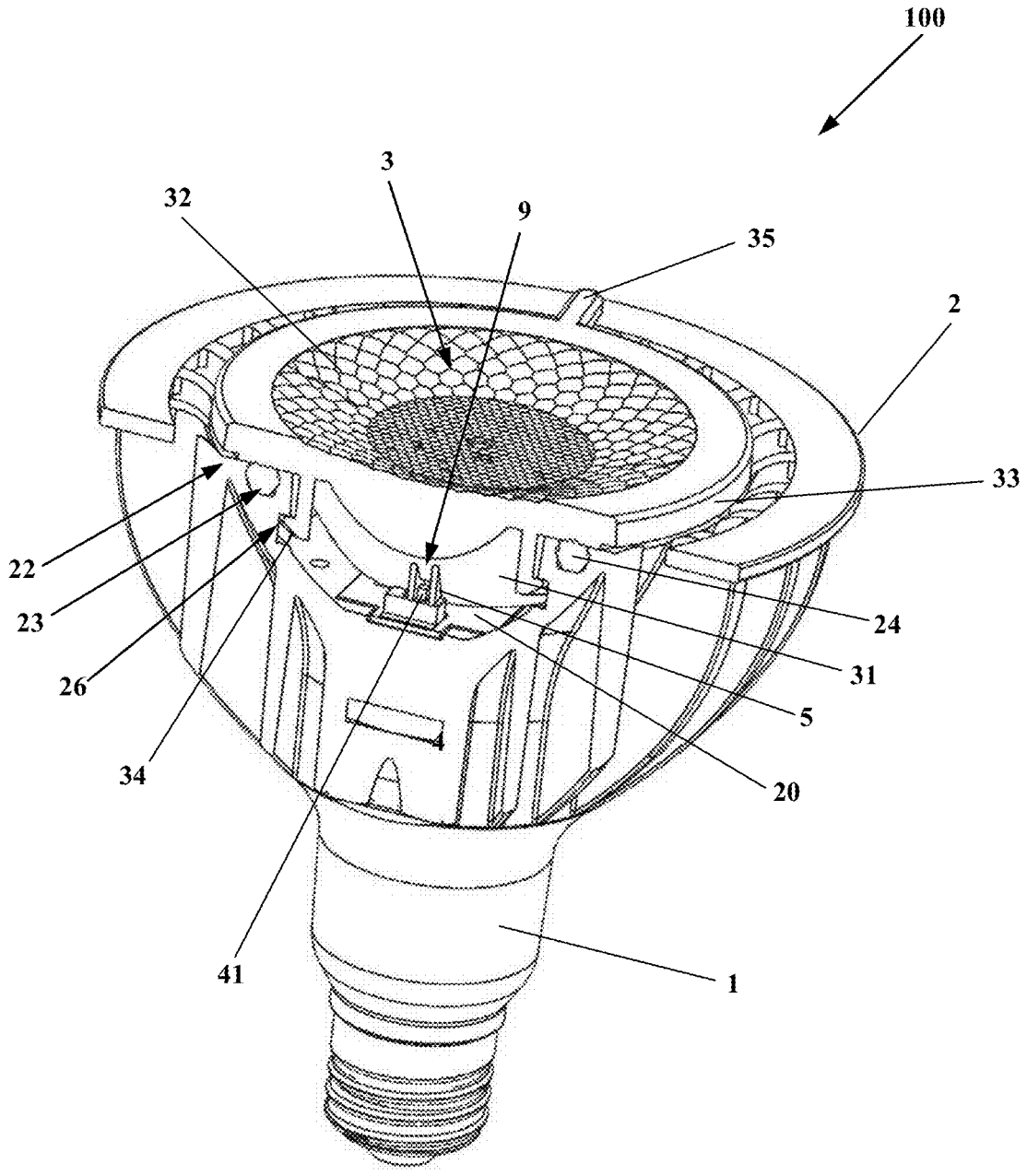
FIG. 2 shows a partial section view of the lamp according to the first embodiment of the present application, showing an internal structure of the lamp.

The optical device 3 may further comprises at least one protrusion 35 transversely outwards extended from an edge of the annular boss 33, as shown in FIG. 2. The protrusion 35 may be used as an auxiliary handle so as to provide an auxiliary device for rotating the optical device 3 to the user. In addition, the protrusion 35 may be further cooperated with an indicating mark arranged at the top of the radiator 2, so that clearly present a rotation position of the optical device 3 to the user, thereby further determine a position of the switch 4 and indicate a light color of the optical device 3.

Figure 3:
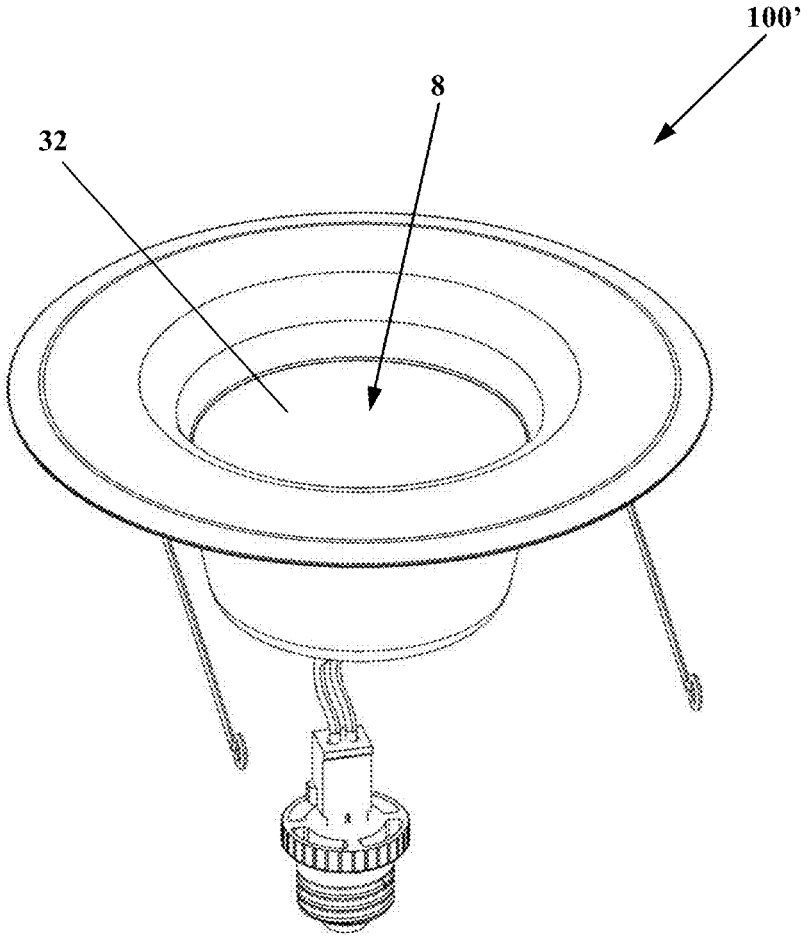
FIG. 3 shows a perspective view of a lamp according to a second embodiment of the present application.
Figure 4:
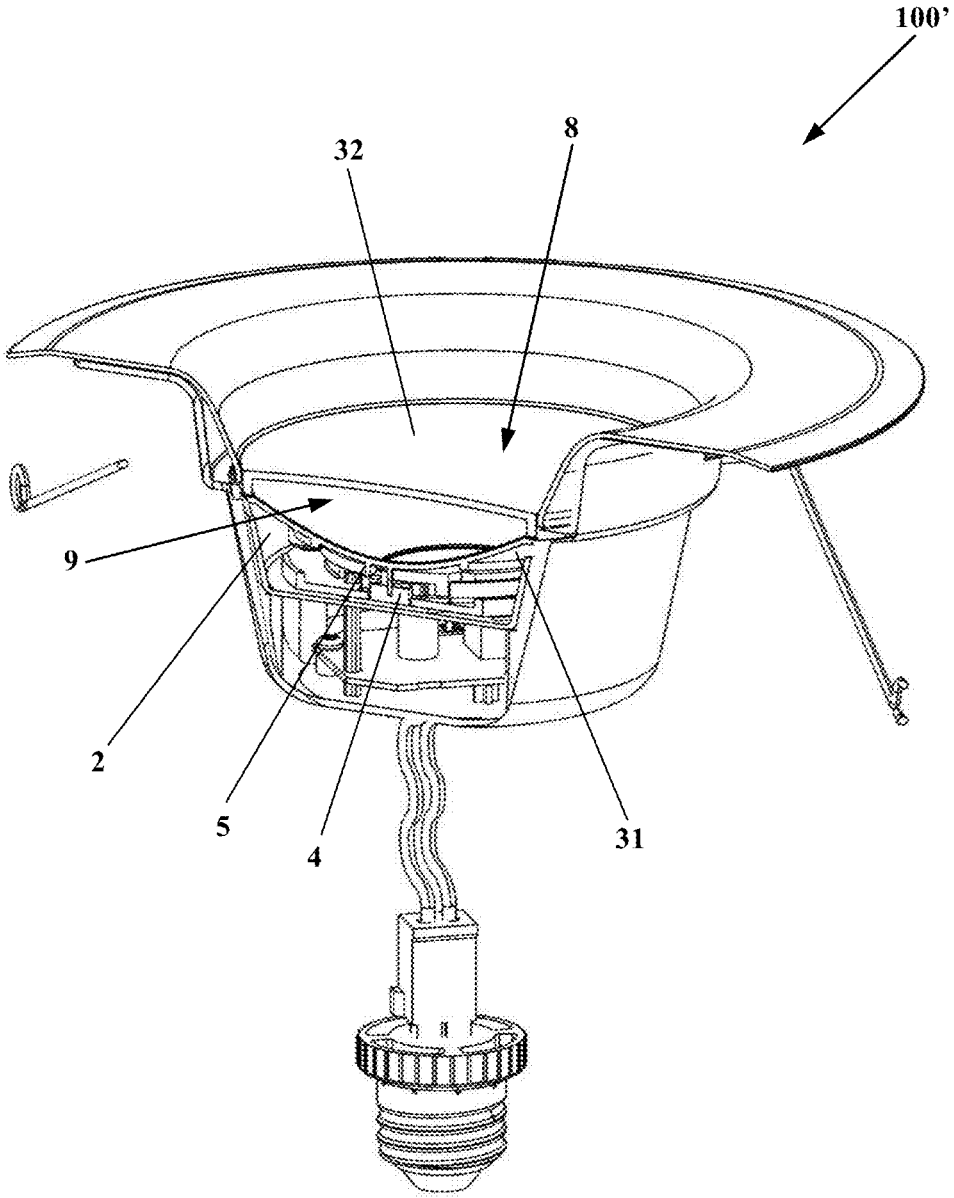
FIG. 4 shows a partial section view of the lamp according to the second embodiment of the present application, showing an internal structure of the lamp.

The lamp 100' of the second embodiment of the present application is described below by reference to FIG. 3 and FIG. 4, wherein the lamp is generally suitable for a downlight. Most of features of the lamp 100' according to the second embodiment of the present application are same to that of the lamp 100 according to the first embodiment of the present application, and only differences between them are described below, and the description of the same feature is omitted.

In the lamp 100' according to the second embodiment of the present application, the optical device 3 is arranged inside the radiator 2. The optical device 3 may comprise a flat diffuser 8 and a conical reflector 9. The diffuser 8 has the top surface 32, and the top surface is preferably a flat surface. The reflector 9 has the bottom surface 31, and the bottom surface is preferably an arc surface. The diffuser 8 with the top surface 32 is fixed with the reflector 9 with the bottom surface 31 together, for example by means of such as snap fitting, welding or bonding, and the way of fixation is not limited specifically.

For the lamp 100' of the second embodiment of the present application, although the optical device 3 is arranged inside the radiator 2, since the diffuser 8 and the reflector 9 are fixed together, the user only needs to manually rotate the top surface 32 of the diffuser 8 so as to switch the switch 4 by the cooperation of the actuator 5 arranged on the bottom surface 31 of the reflector 9 with the switch 4.

Further, grasping grooves opposite along a radial direction may be provided on the top surface 32 of the diffuser 8 of the lamp 100'. Therefore, except that the texture pattern on the top surface 32 of the diffuser 8 is used for the user to manually rotate the optical device 3, the grasping grooves may be further grasped by fingers of the user so that the user can easily rotate the optical device 3.

The above are only optimal embodiments of the present application, and are not intended to limit the present application. Various changes and variations may be made to the present application by persons skilled in the art. Any modifications, equivalent replacements, improvements and the like made within spirits and principles of the present application shall fall within a scope of protection of the present application.

What is claimed is:

1. A lamp, comprising:

a housing;

a radiator provided with an accommodating space for accommodating a light source and a Printed Circuit Board (PCB) board;

an optical device having a bottom surface facing towards the radiator and a top surface facing towards external space; and a switch connected to the PCB board, wherein the optical device comprises an actuator that is cooperated with the switch, wherein the actuator is arranged on the bottom surface of the optical device, and the switch is arranged on an inner side wall or an inner bottom wall of the radiator, and wherein the optical device is rotatably arranged relative to the radiator such that the switch is triggered by rotating the optical device.

2. The lamp as claimed in claim 1, wherein the radiator is cup-shaped, and the optical device is at least partially arranged in the radiator.

3. The lamp as claimed in claim 1, wherein the bottom surface is an arc surface, and the top surface is a flat surface.

4. The lamp as claimed in claim 1, wherein the actuator comprises two tabs protruding from an eccentric position on the bottom surface, the two tabs are mutually parallel and separated by a predetermined space, and a switching trigger arranged on the switch is accommodated in the predetermined space.

5. The lamp as claimed in claim 1, wherein the top surface is provided with a texture pattern so as to increase a friction coefficient of the top surface.

6. The lamp as claimed in claim 1, wherein the optical device further comprises a radially extended annular boss positioned at the top, which is arranged outside the radiator and placed on an annular top edge of the radiator, wherein the annular top edge of the radiator is provided with an annular groove therein, and a seal ring is provided in the annular groove.

7. The lamp as claimed in claim 6, wherein the optical device further comprises a plurality of hooks extended from the annular boss downwards, the radiator further comprises an annular recess dented into the inner side wall of the radiator, and the plurality of hooks are cooperated with the annular recess so that the optical device is fixed with the radiator.

8. The lamp as claimed in claim 6, wherein the optical device further comprises at least one protrusion transversely extended outwards from an edge of the annular boss.

9. The lamp as claimed in claim 1, wherein the optical device comprises a flat diffuser and a conical reflector, the diffuser has the top surface, the reflector has the bottom surface, and the diffuser is fixed with the reflector together.

10. The lamp as claimed in claim 4, wherein when the user rotates the optical device, the two tabs perform rotation movement in a certain degree along with the optical device and during the rotation movement, one of the tabs abuts against the switching trigger of the switch, so that the switching trigger is driven to perform a translation movement, thereby the switch is switched.

11. The lamp as claimed in claim 4, in the predetermined space, the switching trigger has a certain margin such that the switching trigger does not simultaneously close contact with the two tabs and a torsion effect is applied to the switching trigger by a movement component in a radial direction while the tabs perform the rotation movement is decreased in a certain degree.

12. The lamp as claimed in claim 6, further comprising at least one protrusion transversely outwards extended from an edge of the annular boss, wherein the protrusion is used as an auxiliary handle to provide an auxiliary device for rotating the optical device.

13. The lamp as claimed in claim 6, further comprising an indicating mark arranged at the top of the radiator and the protrusion is cooperated with the indicating mark to present a rotation position of the optical device to a user to determine a position of the switch and to indicate a light color of the optical device.

14. The lamp as claimed in claim 1, wherein the switch is a slide switch.

* * * * *